US010479570B2

(12) United States Patent
Streisfeld

(10) Patent No.: US 10,479,570 B2
(45) Date of Patent: Nov. 19, 2019

(54) BOTTLE AND CAP ASSEMBLY FOR SELECTIVELY DISPENSING ONE BEVERAGE INTO ANOTHER BEVERAGE

(71) Applicant: Mark Streisfeld, Boca Raton, FL (US)

(72) Inventor: Mark Streisfeld, Boca Raton, FL (US)

( * ) Notice: Subject to any disclaimer, the term of this patent is extended or adjusted under 35 U.S.C. 154(b) by 111 days.

(21) Appl. No.: 15/898,746

(22) Filed: Feb. 19, 2018

(65) Prior Publication Data

US 2019/0256262 A1 Aug. 22, 2019

(51) Int. Cl.
*B65D 51/28* (2006.01)
*B65D 41/20* (2006.01)

(52) U.S. Cl.
CPC ..... *B65D 51/2835* (2013.01); *B65D 41/20* (2013.01)

(58) Field of Classification Search
CPC ..... B65D 51/2835; B65D 41/20
USPC ..... 215/227, 297, 301; 220/277, 278; 206/0.5, 219, 222
See application file for complete search history.

(56) References Cited

U.S. PATENT DOCUMENTS 4,103,772 A * 8/1978 Wiegner ..... B65D 81/3222 206/222
5,566,845 A * 10/1996 Frank ..... B65D 25/44 215/208
5,950,819 A * 9/1999 Sellars ..... B65D 51/2885 206/221
2007/0102306 A1* 5/2007 Lantos ..... B65D 47/243 206/219
2009/0020495 A1* 1/2009 Cheng ..... B65D 51/2835 215/316
2009/0242561 A1* 10/2009 Wellman ..... B65D 51/2828 220/277
2011/0174642 A1* 7/2011 Coon ..... B65D 51/2835 206/222

* cited by examiner

*Primary Examiner* — James N Smalley
(74) *Attorney, Agent, or Firm* — Clements Bernard Walker; Christopher L. Bernard

(57) ABSTRACT

A beverage container and cap assembly for selectively dispensing a first beverage or a powder into a second beverage, including: a beverage container and a cap assembly, wherein the cap assembly includes: a base member; a reservoir member; wherein the reservoir member includes a piercing member disposed therein having a first end that is coupled to a deformable first surface of the reservoir member and a second piercing end that is disposed adjacent to an opposed pierceable second surface of the reservoir member; and a cap structure disposed partially within the base member that is configured to be selectively depressed, thereby contacting the first end of the piercing member and biasing the second piercing end of the piercing member through the opposed pierceable second surface of the reservoir member, thereby allowing the first beverage or the powder to flow from the reservoir member into the beverage container.

23 Claims, 6 Drawing Sheets

BOTTLE AND CAP ASSEMBLY FOR SELECTIVELY DISPENSING ONE BEVERAGE INTO ANOTHER BEVERAGE

FIELD OF THE INVENTION

The present invention relates generally to a bottle and cap assembly for selectively dispensing one beverage into another beverage. One or both of these beverages could be alcoholic beverages, such as sake and beer for selectively making a "sake bomb." One of the beverages could also be replaced with a powder. The bottle could be replaced with any suitable beverage container; "bottle," "beverage container," and "can" being used interchangeably herein.

BACKGROUND OF THE INVENTION

There are a number of convention bottle and cap assemblies for selectively dispensing one beverage (or a powder) into another beverage. Typically, these bottle and cap assemblies perform unreliably and/or are complex and expensive to manufacture.

For example, U.S. Pat. No. 8,083,055 provides a dispensing cap system for dispensing a supplement material through a bottle neck opening and into the bottle. An exemplary embodiment includes a cap member configured for connection to beverage bottle necks of different sizes. A seal member is arranged to provide a liquid seal against the neck opening. A valve member passes through a storage member attached to the cap member, and is configured for movement between a storage position and a dispensing position, in which passage is permitted of the supplement material from the storage member into the bottle. A nipple member may be positioned over the valve member to allow the bottle contents to be utilized or consumed.

U.S. Pat. No. 6,165,523 provides a flavor enhancing mechanism for bottled water, club soda, and bland liquid comestibles. The flavor enhancing mechanism includes a bottle cap containing a flexible bellows. The bellows is generally transparently clear, flexible plastic. The bottle cap and bellows are mounted upon a bottle containing a liquid comestible, whose flavor is to be enhanced. The bellows contains concentrates of fruit juices and/or other natural flavors. The bottle cap is designed to be screw threaded or snap fitted onto the standard lip portion of glass or plastic drinking containers. Upon application of a downward force, the flavor enhancers are squeezed from the flexible bellows, and injected downwardly into the bland liquid substances held in the bottle.

U.S. Pat. No. 9,434,519 provides a container and a cap. The cap seals a container while providing a separate internal storage area for liquid or power contents. A seal disposed at the bottom of the cap ensures that the storage area contents remain fresh and sterile until the cap is rotated to release the seal. The clockwise rotation and threaded engagement of the storage area with the lower cylindrical collar and the upper cylindrical collar releases the seal from the bottom of the cap, while centrifugal forces within the cap urge the storage area contents into the container.

US 2003/0072850 provides a drink mix dispenser including a reservoir for drink mix and a stopper for the reservoir, all incorporated into a bottle cap. The stopper and reservoir are relatively moveable within the bottle cap, which is in turn secured to a bottle. By simple manipulations like twisting the cap onto a bottle or pushing/pulling a cap attachment, the stopper reveals an aperture within the reservoir for drink mix to be dispensed from. The all inclusive bottle caps may be provided separately from or in combination with reusable drink containers, saving storage space and creating far reduced container waste.

Finally, US 2015/0144656 provides a dispensing cap for attaching to a container, which includes a dispensing chamber having an interior compartment for holding an ingredient to be dispensed into the container. The top end of the dispensing chamber has a flexible diaphragm and an actuator button and the lower end of the dispensing chamber is connected to a movable cone-shaped member. The dispensing chamber includes a threaded bottle cap for attaching the container to the dispensing cap. A vertical shaft includes four rectangular shaped vanes which engage and push the cone-shaped member at the bottom of the dispensing chamber. This causes the cone-shaped member to move to an open position and thereby form a dispensing opening in the bottom of the interior compartment of the dispensing chamber so that the ingredient housed within the compartment freely passes through the dispensing opening and into the container.

Again, these bottle and cap assemblies typically perform unreliably and/or are complex and expensive to manufacture. Thus, what is still needed in the art is a bottle and cap assembly for selectively dispensing one beverage (or a powder) into another beverage.

BRIEF SUMMARY OF THE INVENTION

In various exemplary embodiments, the present invention provides a bottle and cap assembly for selectively dispensing one beverage into another beverage. One or both of these beverages could be alcoholic beverages, such as sake and beer for selectively making a "sake bomb." One of the beverages could also be replaced with a powder. The bottle could be replaced with any suitable beverage container.

In one exemplary embodiment, the present invention provides a beverage container and cap assembly for selectively dispensing a first beverage or a powder into a second beverage, including: a beverage container configured to contain the second beverage; and a cap assembly coupled to the beverage container, wherein the cap assembly includes: a base member coupled to the beverage container and defining a fluid flow channel from the base member into the beverage container; a reservoir member configured to contain the first beverage or the powder disposed within the base member; wherein the reservoir member includes a piercing member disposed therein having a first end that is coupled to a deformable first surface of the reservoir member and a second piercing end that is disposed adjacent to an opposed pierceable second surface of the reservoir member; and a cap structure disposed partially within the base member that is configured to be selectively depressed, thereby contacting the deformable first surface of the reservoir member and first end of the piercing member and biasing the second piercing end of the piercing member through the opposed pierceable second surface of the reservoir member, thereby allowing the first beverage or the powder to flow from the reservoir member through a portion of the base member and into the second beverage contained within the beverage container. The beverage container includes one of an aluminum can and a glass bottle. The base member includes a cylindrical structure that is screwed onto a corresponding neck of the beverage container. The base member includes an internal funnel structure configured to selectively direct the first beverage or the powder flow from the reservoir member through the portion of the base member and into the second beverage contained within the beverage container. The piercing member is aligned along a central axis of the reservoir member. The second piercing end of the piercing member includes a sharped conical tip structure configured to selectively pierce the opposed pierceable second surface of the reservoir member. The cap structure is rotatable within the base member from a first locked orientation to a second unlocked configuration, and wherein the cap structure can only be depressed in the second unlocked configuration. The beverage container and cap assembly further includes a bladder member disposed between the opposed pierceable second surface of the reservoir member and the fluid flow channel defined from the base member into the beverage container. Optionally, the first beverage includes sake and the second beverage includes beer.

In another exemplary embodiment, the present invention provides a method for providing a beverage container and cap assembly for selectively dispensing a first beverage or a powder into a second beverage, including: providing a beverage container configured to contain the second beverage; and providing a cap assembly coupled to the beverage container, wherein the cap assembly includes: a base member coupled to the beverage container and defining a fluid flow channel from the base member into the beverage container; a reservoir member configured to contain the first beverage or the powder disposed within the base member; wherein the reservoir member includes a piercing member disposed therein having a first end that is coupled to a deformable first surface of the reservoir member and a second piercing end that is disposed adjacent to an opposed pierceable second surface of the reservoir member; and a cap structure disposed partially within the base member that is configured to be selectively depressed, thereby contacting the deformable first surface of the reservoir member and first end of the piercing member and biasing the second piercing end of the piercing member through the opposed pierceable second surface of the reservoir member, thereby allowing the first beverage or the powder to flow from the reservoir member through a portion of the base member and into the second beverage contained within the beverage container. The beverage container includes one of an aluminum can and a glass bottle. The base member includes a cylindrical structure that is screwed onto a corresponding neck of the beverage container. The base member includes an internal funnel structure configured to selectively direct the first beverage or the powder flow from the reservoir member through the portion of the base member and into the second beverage contained within the beverage container. The piercing member is aligned along a central axis of the reservoir member. The second piercing end of the piercing member includes a sharped conical tip structure configured to selectively pierce the opposed pierceable second surface of the reservoir member. The cap structure is rotatable within the base member from a first locked orientation to a second unlocked configuration, and wherein the cap structure can only be depressed in the second unlocked configuration. The method further includes providing a bladder member disposed between the opposed pierceable second surface of the reservoir member and the fluid flow channel defined from the base member into the beverage container. Optionally, the first beverage includes sake and the second beverage includes beer.

In a further exemplary embodiment, the present invention provides a cap assembly for selectively dispensing a first beverage or a powder into a second beverage disposed in a beverage container selectively coupled to the cap assembly, including: a base member configured to be selectively coupled to the beverage container defining a fluid flow channel from the base member into the beverage container; a reservoir member configured to contain the first beverage or the powder disposed within the base member; wherein the reservoir member includes a piercing member disposed therein having a first end that is coupled to a deformable first surface of the reservoir member and a second piercing end that is disposed adjacent to an opposed pierceable second surface of the reservoir member; and a cap structure disposed partially within the base member that is configured to be selectively depressed, thereby contacting the deformable first surface of the reservoir member and first end of the piercing member and biasing the second piercing end of the piercing member through the opposed pierceable second surface of the reservoir member, thereby allowing the first beverage or the powder to flow from the reservoir member through a portion of the base member and into the second beverage contained within the beverage container selectively coupled to the cap assembly. The base member includes a cylindrical structure that is screwed onto a corresponding neck of the beverage container. The base member includes an internal funnel structure configured to selectively direct the first beverage or the powder flow from the reservoir member through the portion of the base member and into the second beverage contained within the beverage container. The piercing member is aligned along a central axis of the reservoir member. The second piercing end of the piercing member includes a sharped conical tip structure configured to selectively pierce the opposed pierceable second surface of the reservoir member. The cap structure is rotatable within the base member from a first locked orientation to a second unlocked configuration, and wherein the cap structure can only be depressed in the second unlocked configuration. The cap assembly further includes a bladder member disposed between the opposed pierceable second surface of the reservoir member and the fluid flow channel defined from the base member into the beverage container. Optionally, the first beverage includes sake and the second beverage includes beer.

BRIEF DESCRIPTION OF THE DRAWINGS

The present invention is illustrated and described herein with reference to the various drawings, in which like reference numbers are used to denote like assembly components/method steps, as appropriate, and in which.

DETAILED DESCRIPTION OF THE INVENTION

Figure 1:
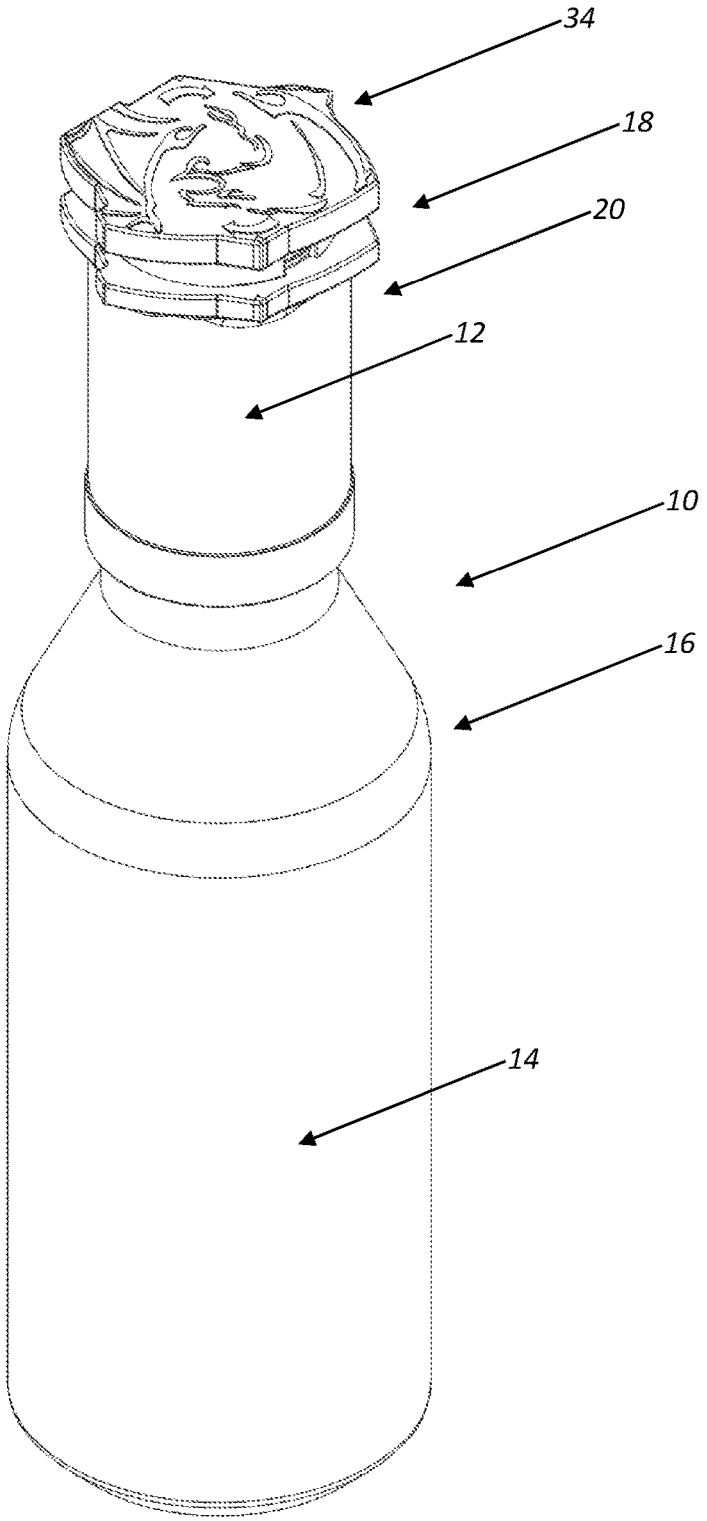
FIG. 1 is a perspective view of one exemplary embodiment of the bottle and cap assembly of the present invention.
Figure 2:
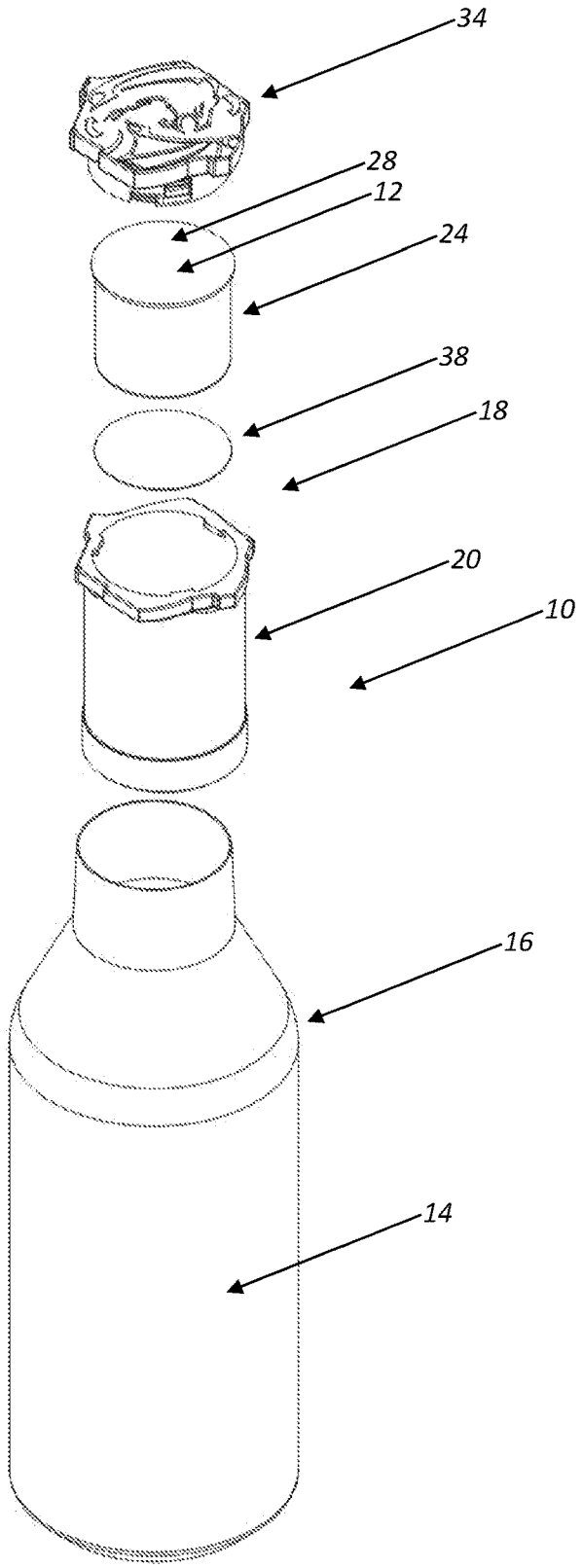
FIG. 2 is an exploded perspective view of one exemplary embodiment of the bottle and cap assembly of the present invention.
Figure 3:
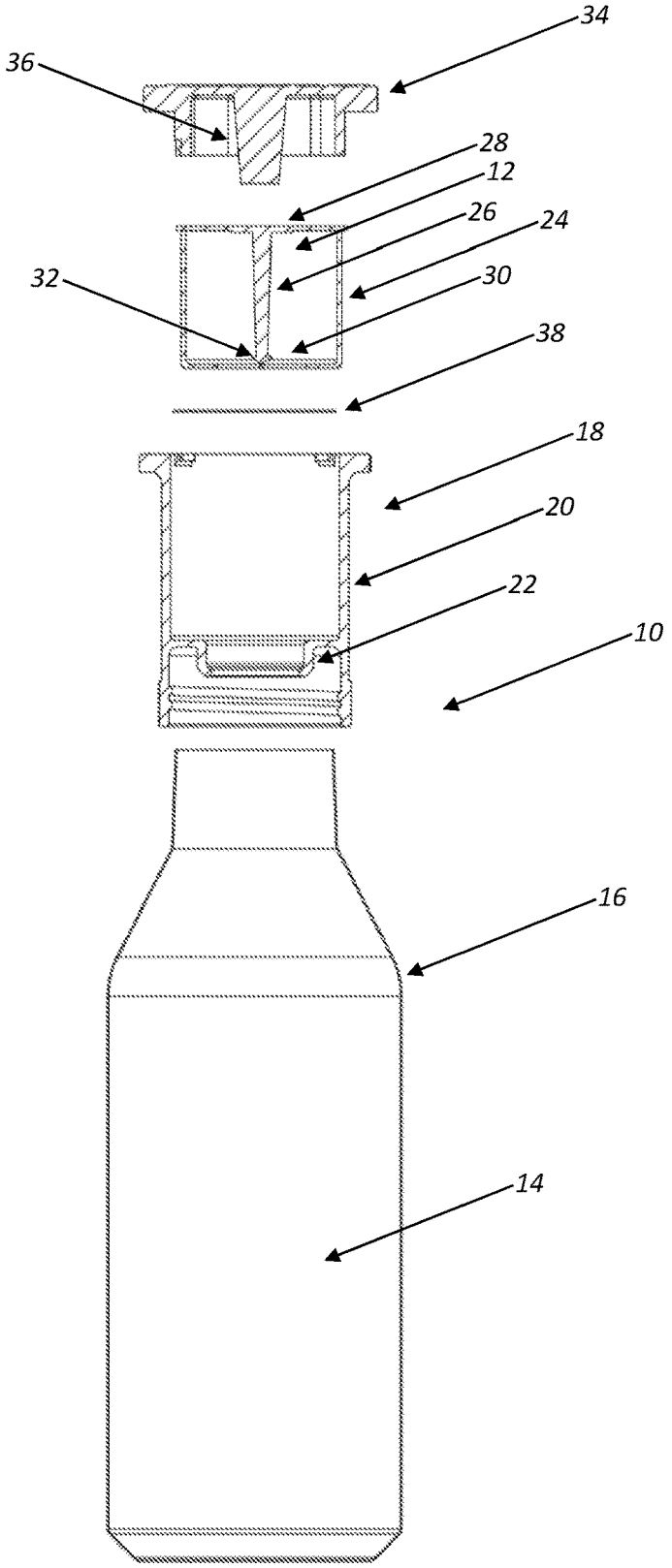
FIG. 3 is an exploded cross-sectional side view of one exemplary embodiment of the bottle and cap assembly of the present invention.

Referring now specifically to FIGS. 1-3, in one exemplary embodiment, the present invention provides a beverage container and cap assembly 10 for selectively dispensing a first beverage or a powder 12 into a second beverage 14, including a beverage container 16 configured to contain the second beverage 14. Preferably, the beverage container 16 includes an aluminum can, a glass bottle, or the like including a conventional screw top neck or the like, typically configured to receive a conventional closure cap or the like. In place of this conventional closure cap or the like, the cap assembly 18 is screwed or otherwise coupled to the beverage container 16. The cap assembly 18 generally includes a base member 20 screwed or otherwise coupled to the beverage container 16. Preferably, the base member 20 includes a hollow cylindrical structure that is screwed onto or otherwise coupled to the corresponding neck of the beverage container 16, although other suitable shapes may be utilized based on a desired design aesthetic. The base member 20 defines a fluid flow channel from the base member 20 into the beverage container 16. Optionally, the base member 20 includes an internal funnel structure 22 (FIG. 3) configured to selectively direct the first beverage or the powder 12 flow from a reservoir member 24 (FIGS. 2 and 3) through a portion of the base member 20 and into the second beverage 14 contained within the beverage container 16. The base member 20 is manufactured from a substantially rigid plastic material or the like. The cap assembly 18 also generally includes the reservoir member 24 configured to contain the first beverage or the powder 12 disposed within the base member 20. The reservoir member 24 is manufactured, partially or wholly, from a substantially flexible plastic material or the like and fits conformally within the base member 20. The reservoir member 24 includes a substantially rigid piercing member 26 (FIG. 3) disposed therein having a first end that is coupled to a deformable first surface 28 (FIGS. 2 and 3) of the reservoir member 24 and a second piercing end that is disposed adjacent to an opposed pierceable second surface 30 (FIG. 3) of the reservoir member 24. Preferably, the piercing member 26 is aligned along a central axis of the reservoir member 24. Optionally, the second piercing end of the piercing member 26 includes a sharped conical tip structure 32 (FIG. 3) configured to selectively pierce the opposed pierceable second surface 30 of the reservoir member 24. The cap assembly 18 further generally includes a cap structure 34 disposed partially within the base member 20 that is configured to be selectively depressed, thereby contacting the deformable first surface 28 of the reservoir member 24 and first end of the piercing member 26 and biasing the second piercing end of the piercing member 26 through the opposed pierceable second surface 30 of the reservoir member 24, thereby allowing the first beverage or the powder 12 to flow from the reservoir member 24 through a portion of the base member 20 and into the second beverage 14 contained within the beverage container 16. Optionally, this contact is made by a protruding member 36 (FIG. 3) coupled to or integrally formed with the cap structure 34. The cap structure 34 is rotatable within the base member 20 from a first locked orientation to a second unlocked configuration. The cap structure 34 can only be depressed in the second unlocked configuration. Optionally, the beverage container and cap assembly 10 further includes a bladder member 38 (FIGS. 2 and 3) disposed between the opposed pierceable second surface 30 of the reservoir member 24 and the fluid flow channel defined from the base member 20 into the beverage container 16. Optionally, the first beverage 12 includes sake and the second beverage 14 includes beer.

Figure 4:
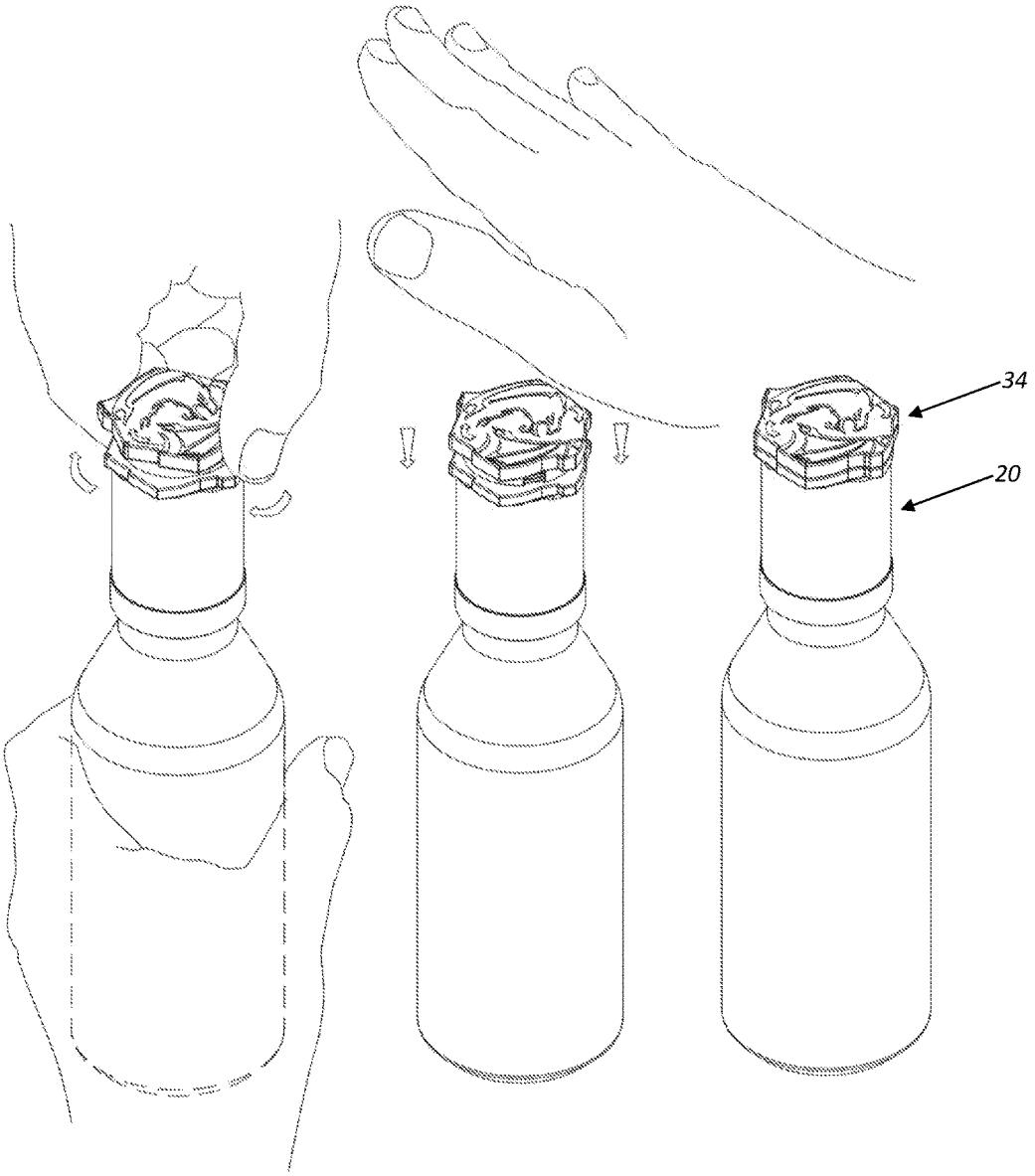
FIG. 4 is a plurality of perspective views illustrating the operation of one exemplary embodiment of the bottle and cap assembly of the present invention.

FIG. 4 illustrates this rotation of the cap structure 34 within the base member 20 from the first locked orientation to the second unlocked configuration. Again, the cap structure 34 can only be depressed in the second unlocked configuration.

Figure 5:
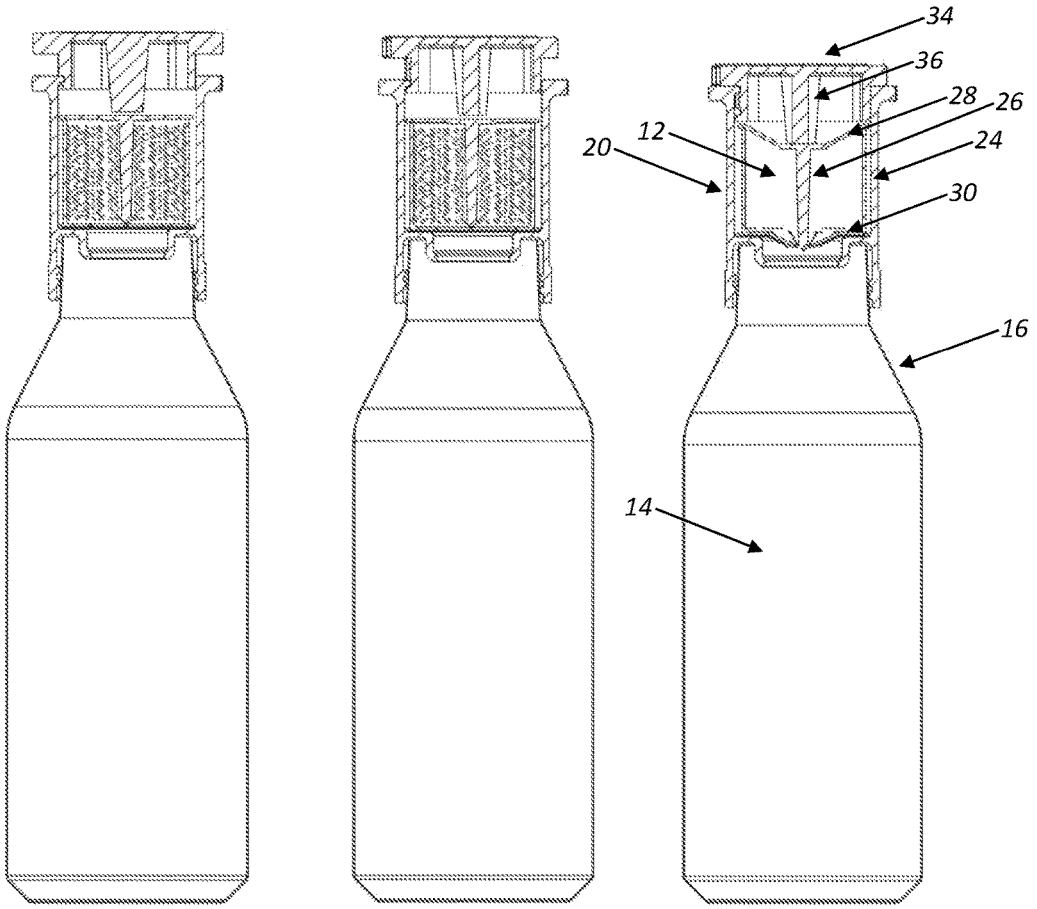
FIG. 5 is a plurality of cross-sectional side views illustrating the operation of one exemplary embodiment of the bottle and cap assembly of the present invention.

FIG. 5 illustrates the cap structure 34 being selectively depressed, thereby contacting the deformable first surface 28 of the reservoir member 24 and first end of the piercing member 26 and biasing the second piercing end of the piercing member 26 through the opposed pierceable second surface 30 of the reservoir member 24, thereby allowing the first beverage or the powder 12 to flow from the reservoir member 24 through a portion of the base member 20 and into the second beverage 14 contained within the beverage container 16. Again, this contact is optionally made by a protruding member 36 coupled to or integrally formed with the cap structure 34.

Figure 6:
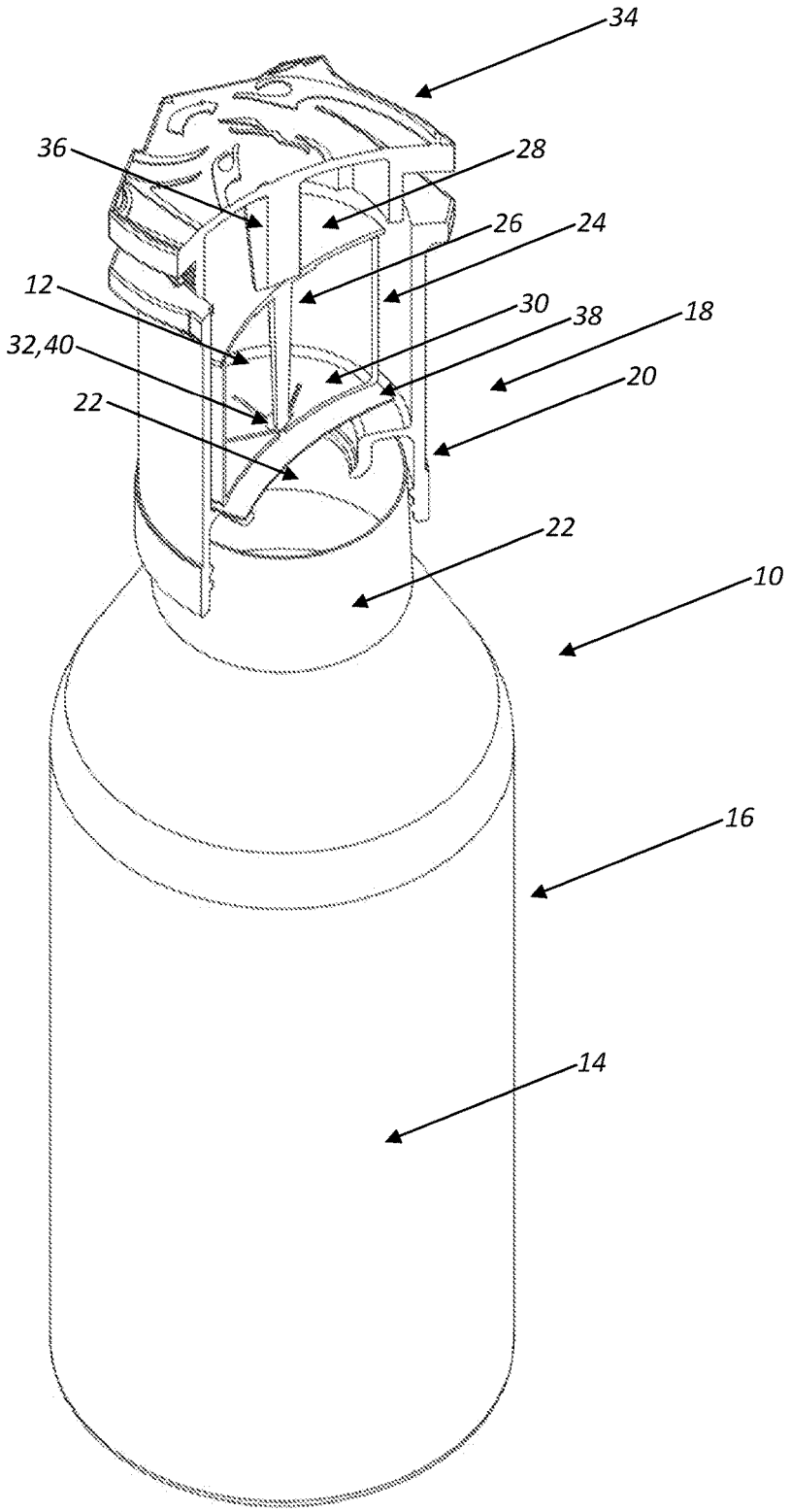
FIG. 6 is a cut away perspective view of one exemplary embodiment of the bottle and cap assembly of the present invention.

Referring now specifically to FIG. 6, in a perspective view, the present invention again provides a beverage container and cap assembly 10 for selectively dispensing a first beverage or a powder 12 into a second beverage 14, including a beverage container 16 configured to contain the second beverage 14. Preferably, the beverage container 16 includes an aluminum can, a glass bottle, or the like including a conventional screw top neck or the like, typically configured to receive a conventional closure cap or the like. In place of this conventional closure cap or the like, the cap assembly 18 is screwed or otherwise coupled to the beverage container 16. The cap assembly 18 generally includes a base member 20 screwed or otherwise coupled to the beverage container 16. Preferably, the base member 20 includes a hollow cylindrical structure that is screwed onto or otherwise coupled to the corresponding neck of the beverage container 16, although other suitable shapes may be utilized based on a desired design aesthetic. The base member 20 defines a fluid flow channel from the base member 20 into the beverage container 16. Optionally, the base member 20 includes an internal funnel structure 22 configured to selectively direct the first beverage or the powder 12 flow from a reservoir member 24 through a portion of the base member 20 and into the second beverage 14 contained within the beverage container 16. The base member 20 is manufactured from a substantially rigid plastic material or the like. The cap assembly 18 also generally includes the reservoir member 24 configured to contain the first beverage or the powder 12 disposed within the base member 20. The reservoir member 24 is manufactured, partially or wholly, from a substantially flexible plastic material or the like and fits conformally within the base member 20. The reservoir member 24 includes a substantially rigid piercing member 26 disposed therein having a first end that is coupled to a deformable first surface 28 of the reservoir member 24 and a second piercing end that is disposed adjacent to an opposed pierceable second surface 30 of the reservoir member 24, optionally including a plurality of piercing relief structures 40 manufactured therein. Preferably, the piercing member 26 is aligned along a central axis of the reservoir member 24. Optionally, the second piercing end of the piercing member 26 includes a sharped conical tip structure 32 configured to selectively pierce the opposed pierceable second surface 30 of the reservoir member 24. The cap assembly 18 further generally includes a cap structure 34 disposed partially within the base member 20 that is configured to be selectively depressed, thereby contacting the deformable first surface 28 of the reservoir member 24 and first end of the piercing member 26 and biasing the second piercing end of the piercing member 26 through the opposed pierceable second surface 30 of the reservoir member 24, thereby allowing the first beverage or the powder 12 to flow from the reservoir member 24 through a portion of the base member 20 and into the second beverage 14 contained within the beverage container 16. Optionally, this contact is made by a protruding member 36 coupled to or integrally formed with the cap structure 34. The cap structure 34 is rotatable within the base member 20 from a first locked orientation to a second unlocked configuration. The cap structure 34 can only be depressed in the second unlocked configuration. Optionally, the beverage container and cap assembly 10 further includes a bladder member 38 disposed between the opposed pierceable second surface 30 of the reservoir member 24 and the fluid flow channel defined from the base member 20 into the beverage container 16. Optionally, the first beverage 12 includes sake and the second beverage 14 includes beer.

Although the present invention is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following non-limiting claims for all purposes.

What is claimed is:

1. A beverage container and cap assembly for selectively dispensing a first beverage or a powder into a second beverage, comprising:

a beverage container configured to contain the second beverage; and a cap assembly coupled to the beverage container, wherein the cap assembly comprises:

a base member coupled to the beverage container and defining a fluid flow channel from the base member into the beverage container;

a reservoir member configured to contain the first beverage or the powder disposed within the base member;

wherein the reservoir member comprises a piercing member disposed therein having a first end that is coupled to a deformable first surface of the reservoir member and a second piercing end that is disposed adjacent to an opposed pierceable second surface of the reservoir member; and a cap structure disposed partially within the base member that is configured to be selectively depressed, thereby contacting the deformable first surface of the reservoir member and first end of the piercing member and biasing the second piercing end of the piercing member through the opposed pierceable second surface of the reservoir member, thereby allowing the first beverage or the powder to flow from the reservoir member through a portion of the base member and into the second beverage contained within the beverage container;

wherein the base member comprises an internal funnel structure configured to selectively direct the first beverage or the powder flow from the reservoir member through the portion of the base member and into the second beverage contained within the beverage container.

2. The beverage container and cap assembly of claim 1, wherein the beverage container comprises one of an aluminum can and a glass bottle.

3. The beverage container and cap assembly of claim 1, wherein the base member comprises a cylindrical structure that is screwed onto a corresponding neck of the beverage container.

4. The beverage container and cap assembly of claim 1, wherein the piercing member is aligned along a central axis of the reservoir member.

5. The beverage container and cap assembly of claim 1, wherein the second piercing end of the piercing member comprises a sharped conical tip structure configured to selectively pierce the opposed pierceable second surface of the reservoir member.

6. The beverage container and cap assembly of claim 1, wherein the cap structure is rotatable within the base member from a first locked orientation to a second unlocked configuration, and wherein the cap structure can only be depressed in the second unlocked configuration.

7. The beverage container and cap assembly of claim 1, further comprising a bladder member disposed between the opposed pierceable second surface of the reservoir member and the fluid flow channel defined from the base member into the beverage container.

8. The beverage container and cap assembly of claim 1, wherein the first beverage comprises sake and the second beverage comprises beer.

9. A method for providing a beverage container and cap assembly for selectively dispensing a first beverage or a powder into a second beverage, comprising:

providing a beverage container configured to contain the second beverage; and providing a cap assembly coupled to the beverage container, wherein the cap assembly comprises:

a base member coupled to the beverage container and defining a fluid flow channel from the base member into the beverage container;

a reservoir member configured to contain the first beverage or the powder disposed within the base member;

wherein the reservoir member comprises a piercing member disposed therein having a first end that is coupled to a deformable first surface of the reservoir member and a second piercing end that is disposed adjacent to an opposed pierceable second surface of the reservoir member; and a cap structure disposed partially within the base member that is configured to be selectively depressed, thereby contacting the deformable first surface of the reservoir member and first end of the piercing member and biasing the second piercing end of the piercing member through the opposed pierceable second surface of the reservoir member, thereby allowing the first beverage or the powder to flow from the reservoir member through a portion of the base member and into the second beverage contained within the beverage container;

wherein the base member comprises an internal funnel structure configured to selectively direct the first beverage or the powder flow from the reservoir member through the portion of the base member and into the second beverage contained within the beverage container.

10. The method of claim 9, wherein the beverage container comprises one of an aluminum can and a glass bottle.

11. The method of claim 9, wherein the base member comprises a cylindrical structure that is screwed onto a corresponding neck of the beverage container.

12. The method of claim 9, wherein the piercing member is aligned along a central axis of the reservoir member.

13. The method of claim 9, wherein the second piercing end of the piercing member comprises a sharped conical tip structure configured to selectively pierce the opposed pierceable second surface of the reservoir member.

14. The method of claim 9, wherein the cap structure is rotatable within the base member from a first locked orientation to a second unlocked configuration, and wherein the cap structure can only be depressed in the second unlocked configuration.

15. The method of claim 9, further comprising providing a bladder member disposed between the opposed pierceable second surface of the reservoir member and the fluid flow channel defined from the base member into the beverage container.

16. The method of claim 9, wherein the first beverage comprises sake and the second beverage comprises beer.

17. A cap assembly for selectively dispensing a first beverage or a powder into a second beverage disposed in a beverage container selectively coupled to the cap assembly, comprising:

a base member configured to be selectively coupled to the beverage container defining a fluid flow channel from the base member into the beverage container;

a reservoir member configured to contain the first beverage or the powder disposed within the base member;

wherein the reservoir member comprises a piercing member disposed therein having a first end that is coupled to a deformable first surface of the reservoir member and a second piercing end that is disposed adjacent to an opposed pierceable second surface of the reservoir member; and a cap structure disposed partially within the base member that is configured to be selectively depressed, thereby contacting the deformable first surface of the reservoir member and first end of the piercing member and biasing the second piercing end of the piercing member through the opposed pierceable second surface of the reservoir member, thereby allowing the first beverage or the powder to flow from the reservoir member through a portion of the base member and into the second beverage contained within the beverage container selectively coupled to the cap assembly;

wherein the base member comprises an internal funnel structure configured to selectively direct the first beverage or the powder flow from the reservoir member through the portion of the base member and into the second beverage contained within the beverage container.

18. The cap assembly of claim 17, wherein the base member comprises a cylindrical structure that is screwed onto a corresponding neck of the beverage container.

19. The cap assembly of claim 17, wherein the piercing member is aligned along a central axis of the reservoir member.

20. The cap assembly of claim 17, wherein the second piercing end of the piercing member comprises a sharped conical tip structure configured to selectively pierce the opposed pierceable second surface of the reservoir member.

21. The cap assembly of claim 17, wherein the cap structure is rotatable within the base member from a first locked orientation to a second unlocked configuration, and wherein the cap structure can only be depressed in the second unlocked configuration.

22. The cap assembly of claim 17, further comprising a bladder member disposed between the opposed pierceable second surface of the reservoir member and the fluid flow channel defined from the base member into the beverage container.

23. The cap assembly of claim 17, wherein the first beverage comprises sake and the second beverage comprises beer.

* * * * *